US007625682B2

(12) United States Patent
Kanazawa et al.

(10) Patent No.: US 7,625,682 B2
(45) Date of Patent: Dec. 1, 2009

(54) ELECTROPHOTOGRAPHIC PHOTORECEPTOR AND IMAGE FORMING APPARATUS

(75) Inventors: Tomoko Kanazawa, Kashihara (JP); Kotaro Fukushima, Kawanishi (JP)

(73) Assignee: Sharp Kabushiki Kaisha, Osaka (JP)

( * ) Notice: Subject to any disclaimer, the term of this patent is extended or adjusted under 35 U.S.C. 154(b) by 240 days.

(21) Appl. No.: 11/198,405

(22) Filed: Aug. 8, 2005

(65) Prior Publication Data

US 2006/0029874 A1 Feb. 9, 2006

(30) Foreign Application Priority Data

Aug. 9, 2004 (JP) ..... P2004-232604

(51) Int. Cl.
*G03G 5/06* (2006.01)

(52) U.S. Cl. ..... 430/72; 430/56; 430/73; 430/159

(58) Field of Classification Search ..... 430/56, 430/72, 73, 159
See application file for complete search history.

(56) References Cited

U.S. PATENT DOCUMENTS 5,573,878 A * 11/1996 Hagiwara et al. ..... 430/58.15
2003/0087171 A1 5/2003 Tokutake et al.
2004/0101770 A1* 5/2004 Obata et al. ..... 430/58.85
2004/0142258 A1* 7/2004 Fukushima et al. ..... 430/56
2005/0287455 A1* 12/2005 Uchino et al. ..... 430/60

FOREIGN PATENT DOCUMENTS

| | | | |
|---|---|---|---|
| JP | 2000-10320 | A | 1/2000 |
| JP | 2002-6526 | A | 1/2002 |
| JP | 2003-43708 | A | 2/2003 |
| JP | 2003-345040 | A | 12/2003 |
| JP | 2004-4454 | A | 1/2004 |
| JP | 2004-53810 | A | 2/2004 |
| JP | 2004-212888 | A | 7/2004 |

* cited by examiner

*Primary Examiner*—Mark F Huff
*Assistant Examiner*—Rachel L Burney
(74) *Attorney, Agent, or Firm*—Nixon & Vanderhye P.C.

(57) ABSTRACT

An electrophotographic photoreceptor having an organic photosensitive layer at the surface layer is provided which can improve the wear resistance, durability and operation stability of the surface layer and can form images with no injury and unevenness in the density for a long period of time. The electrophotographic photoreceptor includes a conductive substrate, an undercoat layer, and a photosensitive layer having a charge generating layer and a charge transporting layer. In the photoreceptor, the photosensitive layer has a creep value $C_K$ of 2.70% or more and an elastic ratio $\eta_{HU}$ of 47% or more in a case where an indentation maximum load of 5 mN is loaded on the surface under a circumstance at a temperature of 25° C. and at a relatively humidity of 50%.

5 Claims, 4 Drawing Sheets

ELECTROPHOTOGRAPHIC PHOTORECEPTOR AND IMAGE FORMING APPARATUS

BACKGROUND OF THE INVENTION

1. Field of the Invention

The present invention related to an electrophotographic photoreceptor and an image forming apparatus.

2. Description of the Related Art

Electrophotographic image forming apparatus have been utilized not only for copying machines but also generally for printers as output means of computers, etc. for which demand has been remarkably increased in recent years. In electrophotographic image forming apparatus, a photosensitive layer of an electrophotographic photoreceptor provided to the apparatus is uniformly charged by a charger, exposing the same, for example, by a laser light corresponding to image information, and a finely particulate developer, which is called as a toner, is supplied to electrostatic latent images formed by exposure from a developing device, to form toner images.

Although toner images formed by adhesion of the toner as a component of a developer to a surface of the electrophotographic photoreceptor is transferred to a transfer material such as recording paper by transfer means, not all the toner on the surface of the electrophotographic photoreceptor is transferred to the recording paper but the toner partially remains on the surface of the electrophotographic photoreceptor. Further, paper dusts of recording paper in contact with the electrophotographic photoreceptor during development may sometimes remain being deposited to the electrophotographic photoreceptor as they are.

Since the residual toner and deposited paper dusts on the surface of the electrophotographic photoreceptor give adverse effects on quality of images to be formed, the residual toner and deposited paper dusts are removed by a cleaning device. Further, a cleanerless technique has been developed in recent years in which the residual toner and deposited paper dusts are removed by a so-called development and cleaning system in which the residual toner is recovered by a cleaning function added to the developing means without providing independent cleaning means. To the electrophotographic photoreceptor, since operations of charging, exposure, development, transfer, cleaning and charge elimination are conducted repetitively, resistance against electrical and mechanical factors have been demanded. Specifically, it has been required for wear resistance against abrasion or scratches occurred upon frictional rubbing to the surface of the electrophotographic photoreceptor or durability against degradation of the surface layer caused by deposition of active substances such as ozone or NOx generated upon charging by the charger.

For attaining cost reduction and maintenance free with respect to the electrophotographic image forming apparatus, it is important that the electrophotographic photoreceptor has sufficient wear resistance and durability and can operate stably for a long period of time. Physical properties of the surface layer constituting the electrophotographic photoreceptor are greatly concerned with the wear resistance, the durability and the long time stability of operation of the electrophotographic photoreceptor. Heretofore, the electrophotographic photoreceptor has been designed to improve the durability by increasing the ratio of a polymeric binder used for the surface layer or by using a binder of a large molecular weight. However, increase of the binder ratio decreases the sensitivity of the photoreceptor and this is not suitable to high speed operation. Further, a binder of large molecular weight involves a problem of increasing the viscosity of a coating solution and thus leads to poor productivity. In view of the foregoings, it has been demanded for making the photoreceptor highly resistant to printing by a quantitative evaluation method.

Hardness is one of indices that evaluate not only physical properties on the surface of an electrophotographic photoreceptor but also generally physical properties of the materials, particularly, mechanical properties. The hardness is defined as a stress from a material against indentation urging of an indenter. An attempt of quantitizing mechanical properties of a film constituting the surface of the electrophotographic photoreceptor by using the hardness as a physical parameter for recognizing physical properties of materials has been conducted. For example, scratch test, pencil hardness test and Vickers hardness test, etc. have been generally known as a test method for measuring the hardness.

However, any of the hardness tests described above involves a problem in measuring mechanical properties of a material sowing complicate behaviors of plasticity, elasticity (also including retarded component) and creeping property in combination. For example, while Vicker's hardness is used for the evaluation of hardness of a film by measuring the length of an indentation, this reflects only the plasticity of the film and can not exactly evaluate a mechanical property showing a deformation state also including a large rate of elastic deformation such as an organic material. Accordingly, the mechanical property of a film constituted with an organic material has to be evaluated while considering various properties.

In an electrophotographic photoreceptor having an organic photosensitive layer at the surface layer, plastic deformation energy ratio (plastic deformation ratio $\eta_{plast}$ %), elastic work efficiency (elastic deformation ratio $\eta_{HU}$ %) etc. have been proposed as the physical property for judging the wear resistance, the durability and the operation stability for a long time of an organic photosensitive layer (refer, for example, to Japanese Unexamined Patent Publications JP-A 2000-10320 and 2002-6526). The plastic deformation energy is a ratio of the plastic deformation energy relative to the sum for a plastic deformation energy (energy required for plastic deformation) and elastic deformation energy (energy required for elastic deformation) represented by percentage. Further, the elastic work efficiency is a ratio of the elastic deformation work energy relative to the sum for the plastic deformation energy and the elastic deformation work energy by the percentage. Accordingly, the sum for plastic deformation energy ratio and the elastic work efficiency is 100(%).

More specifically, JP-A 2000-10320 proposes to set the plastic deformation energy ratio (plastic deformation ratio) to 30 to 70% and set a universal hardness value by universal hardness test according to DIN50359-1 (Hu) to 230 to 700 $N/mm^2$. JP-A 2000-10320 describes that mechanical deterioration for the photoreceptor surface layer is prevented by setting such a range for the numerical values. However, the range for numeral values of the plastic deformation energy of 30 to 70% is a range including substantially all of organic photosensitive layers containing binder resins used generally at present. Accordingly, even when the plastic deformation energy ratio is within the range described above, this can not always provide an organic photosensitive layer excellent in long time wear resistance, durability and operation stability.

Further, JP-A No. 2002-6526 proposes an electrophotographic photoreceptor having an organic photosensitive layer and a protective layer containing a curable resin as a binder resin on a conductive substrate, and in which the elastic work efficiency $\eta_{HU}$ of the protective layer (=[elastic deformation energy/(plastic work energy+elastic deformation energy)]×100) is from 32 to 60%. However, the numerical values of 32 to 60% for the elastic work efficiency is identical with that of 40 to 68% for the plastic deformation energy ratio which is a range including substantially all of electrophotographic photoreceptors formed with organic photosensitive layers as the surface layer. Further, the curable resin used as the binder resin is also ordinary in the technical field of the electrophotographic photoreceptor. Accordingly, JP-A 2002-6526 neither discloses means for solution in order substantially to obtain an organic photosensitive layer excellent in the long time wear resistance, durability, and operation stability. Further, the electrophotographic photoreceptor of JP-A 2002-6526 involves a problem of increasing the cost in the formation of the protective layer containing the curable resin.

SUMMARY OF THE INVENTION

An object of the invention is to provide an electrophotographic photoreceptor excellent in wear resistance, durability and operation stability and capable of forming images with no injuries and unevenness in the density for a long period of time.

The invention provides an electrophotographic photoreceptor comprising:

a conductive substrate; and an organic photosensitive layer, wherein the organic photosensitive layer has a creep value $C_{Jr}$ of 2.70% or more and an elastic work efficiency $\eta_{HU}$ of 47% or more when an indentation maximum load of 5 mN is loaded on its surface under a circumstance at a temperature of 25° C. and at a relative humidity of 50%.

In the invention it is preferable that the organic photosensitive layer contains a compound represented by the following structural formula (1).

(1)

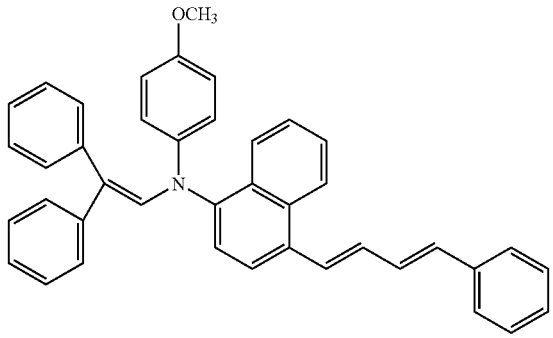

In the invention it is preferable that the organic photosensitive layer contains a compound represented by the following structural formula (3).

(3)

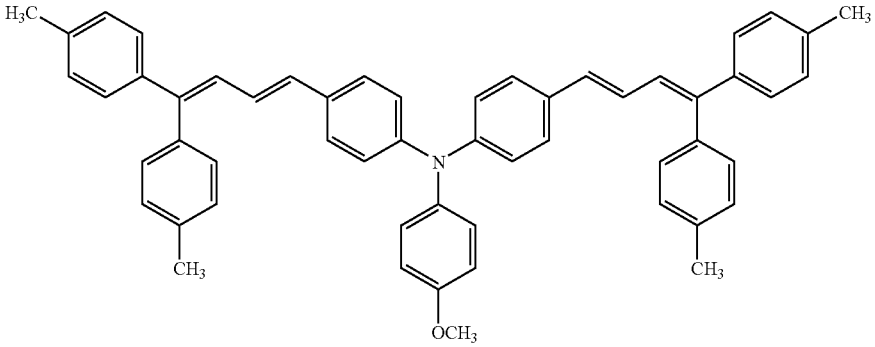

Further, in the invention it is preferable that the creep value $C_{Jr}$ is 3.00% or more.

Furthermore, the invention provides an image forming apparatus comprising any of the electrophotographic photoreceptors described above; and cleaning means for cleaning a surface of the electrophotographic photoreceptor after transfer of a toner image formed thereon.

In the invention, it is preferable that the image forming apparatus further comprises:

charging means for uniformly charging the surface of the electrophotographic photoreceptor;

exposure means for exposing the charged electrophotographic photoreceptor to light to form an electrostatic latent image;

developing means of developing the electrostatic latent image to form a visible image; and transfer means for transferring the visible image to a transfer material.

According to the invention, in the electrophotographic photoreceptor used for electrophotographic image formation and having a conductive substrate and an organic photosensitive layer, the surface physical property thereof is set such that the creep value $C_{Jr}$ is 2.70% or more, preferably, 3.00% or more, and the elastic work efficiency $\eta_{HU}$ is 47% or more in a case where an indentation maximum load of 5 mN is loaded on the surface under a circumstance at a temperature of 25° C. and at a relative humidity of 50%. This can appropriately maintain the soft and flexibility of a film forming the surface layer of the electrophotographic photoreceptor, that is, balance between the viscosity and the elasticity, and provide a favorable state not fragile to external stress. Accordingly, since the amount of film reduction is decreased and the occurrence of injuries to the film is also decreased to keep the smoothness on the surface of the photoreceptor during long time use in which image formation of charging, exposure, development, transfer, cleaning and charge elimination is conducted repetitively, occurrence of injuries and unevenness in the density to the formed images can be prevented.

Further, since the photosensitive layer contains the compound represented by the structural formula (1), an electrophotographic photoreceptor excellent in wear resistance life and scratch resistance can be attained.

Further, according to the invention, since an electrophotographic photoreceptor of excellent wear resistance life and scratch resistance is provided, an image forming apparatus not causing injuries and unevenness in the density to the formed images for a long period of time can be attained.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
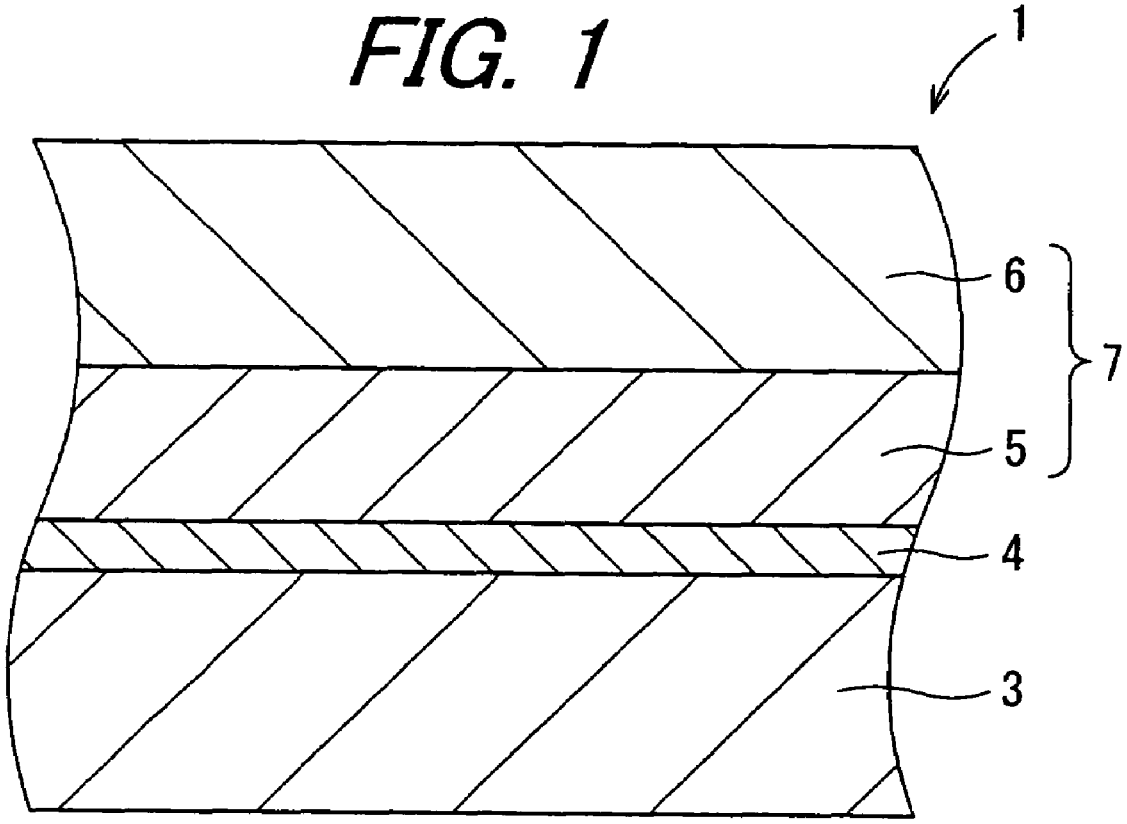
FIG. 1 is a fragmentary cross sectional view schematically showing the constitution of an electrophotographic photoreceptor according to one embodiment of the invention.

Now referring to the drawings, preferred embodiments of the invention are described below.

Figure 2:
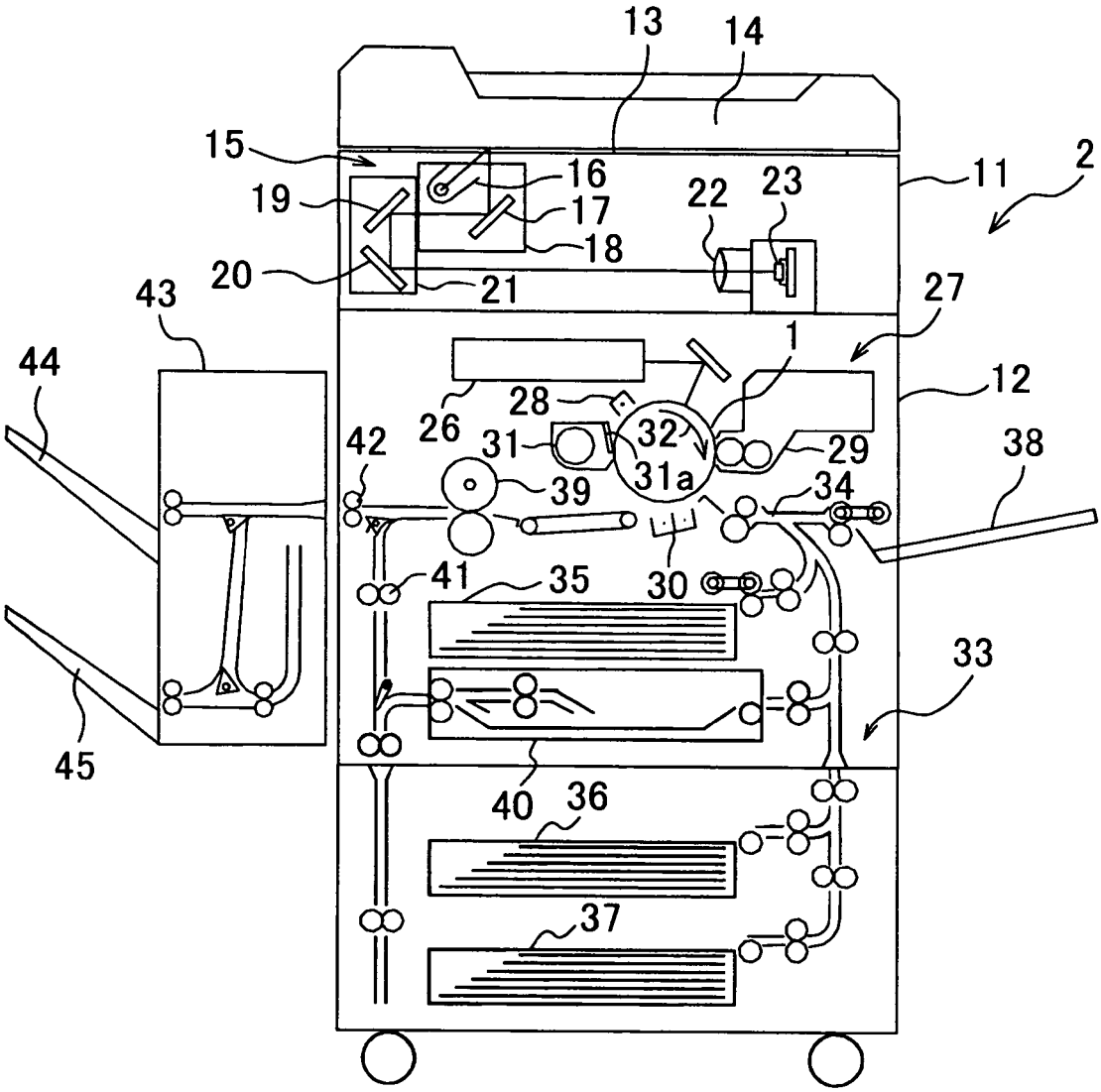
FIG. 2 is a side elevational view for the arrangement schematically showing the constitution of an image forming apparatus according to another embodiment of the invention having the electrophotographic photoreceptor shown in FIG. 1.

FIG. 1 is a fragmentary cross sectional view schematically showing the constitution of an electrophotographic photoreceptor according to one embodiment of the invention, and FIG. 2 is a side elevational view for the arrangement schematically showing the constitution of an image forming apparatus 2 according to another embodiment of the invention.

The electrophotographic photoreceptor 1 (hereinafter simply referred to as a photoreceptor) comprises a conductive substrate 3 made of a conductive material, an undercoat layer 4 laminated on the conductive substrate 3, a charge generating layer 5 which is a layer laminated on the undercoat layer 4 and contains a charge generating substance, and a charge transporting layer 6 which is a layer stacked further on the charge generating layer 5 and contains a charge transporting substance. The charge generating layer 5 and the charge transporting layer 6 constitute a photosensitive layer 7.

The conductive substrate 3 has a cylindrical shape, for which (a) a metal material such as aluminum, stainless steel, copper and nickel, or (b) an insulating material such as polyester film, phenol resin pipe, or paper pipe provided on the surface thereof with a conductive layer such as aluminum, copper, palladium, tin oxide, or indium oxide is preferably used. Those having electroconductivity at a volumic resistance of $10^{10}$ Ω·cm or less are preferred. The conductive substrate 3 may be applied with an oxidation treatment to the surface with an aim of controlling the volumic resistance. The conductive substrate 3 functions as an electrode for the photoreceptor 1, as well as also functions as a support member for each of other layers 4, 5 and 6. The shape of the conductive substrate 3 is not restricted only to the cylindrical shape and any of plate-like, film-like, or belt-like shape may also be used.

The undercoat layer 4 is formed, for example, of polyamide, polyurethane, cellulose, nitrocellulose, polyvinyl alcohol, polyvinylpyrrolidone, polyacrylamide, anodized aluminum film, gelatin, starch, casein, or N-methoxymethylated nylon. Further, particles such as titanium oxide, tin oxide or aluminum oxide may be dispersed in the undercoat layer 4. The undercoat layer 4 is formed to a thickness of about 0.1 to 10 μm. The undercoat layer 4 serves as an adhesive layer between the conductive substrate 3 and the photosensitive layer 7, as well as functions also as a barrier layer that suppresses charges from flowing from the conductive substrate 3 to the photosensitive layer 7. As described above, since the undercoat layer 4 functions so as to maintain the charging characteristics of the photoreceptor 1, it is possible to extend the life of the photoreceptor 1.

The charge generating layer 5 can be constituted with incorporation of a known charge generating substance. As the charge generating substance, any of inorganic pigments, organic pigments and organic dyes can be used so long as the material absorbs visible rays to generate free charges. Examples of the inorganic pigments include selenium and alloys thereof, arsenic-selenium, cadmium sulfide, zinc oxide, amorphous silicon and other inorganic photoconductive materials. Examples of the organic pigment include phtalocyanine compounds, azo compounds, quinacridone compounds, polycyclic quinone compounds, and perylene compounds. Examples of the organic dyes include thiapyrylium salts and squarylium salts. Among the charge generating substances, organic photoconductive compounds such as organic pigments and organic dyes are preferably used and among the organic photoconductive compounds, phthalocyanine compounds are preferably used. Particularly, use of titanylphthalocyanine compounds in most preferred and satisfactory sensitivity, chargeability and reproducibility can be obtained. The charge generating substance can be used alone or two or more of them can be used in combination.

In addition to the pigments and dyes described above, the charge generating layer 5 may be incorporated with a chemical sensitizer or a photosensitizer. Examples of the chemical sensitizer include electron accepting substances, for example, cyano compounds such as tetracyanoethylene, or 7,7,8,8-tetracyanoquinodimethane, quinones such as anthraquinone or p-benzoquinone and nitro compounds such as 2,4,7-trinitrofluolenone or 2,4,5,7-tetranitrofluolenone. Examples of the photosensitizer include dyes such as xanthene dyes, thiadine dyes, or triphenylmethane dyes. The chemical sensitizers and photosensitizers may be used alone individually or two or more of them may be used in combination.

The charge generating layer 5 is prepared by dispersing the charge generating substance together with a binder resin in an appropriate solvent, and applying the dispersion on a undercoat layer 4, followed by drying or curing the applied dispersion to form a film. Specific examples of the binder resin include, polyacrylate, polyvinyl butyral, polycarbonate, polyester, polystyrene, polyvinyl chloride, phenoxy resin, epoxy resin, silicone, and polyacrylate. The binder resins can be used alone or two or more of them may be used in combination. The solvent include, for example, isopropyl alcohol, cyclohexanone, cyclohexane, toluene, xylene, acetone, methyl ethyl ketone, tetrahydrofuran, dioxane, dioxolane, ethylcellosolve, ethyl acetate, methyl acetate, dichloromethane, dichloroethane, monochlorbenzene and ethylene glycol dimethyl ether.

The solvent is not limited to those described above, and any solvent selected among the group consisting of alcohols, ketones, amides, esters, ethers, hydrocarbons, chlorinated hydrocarbons, and aromatics may be used alone or in admixture. However, considering the degradation of sensitivity resulted from crystal relocation upon pulverization and milling of the charge generating substance and deterioration of characteristics due to the pot life, use of any one of cyclohexanone, 1,2-dimethoxyethane, methyl ethyl ketone and tetrahydroquione which causes less crystal relocation for organic or inorganic pigments is preferred.

For the formation of the charge generating layer 5, a vapor phase deposition method such as a vacuum vapor deposition method, sputtering method or CVD method, coating method or the like can be used. In a case of using the coating method, a coating solution prepared by pulverizing the charge generating substance by a ball mill, sand grinder, paint shaker, or ultrasonic disperser and dispersing the pulverizate in a solvent, and optionally adding of a binder resin is coated on undercoat layer 4 by a known coating method. In a case where the conductive substrate 3 formed with the undercoat layer 4 has a cylindrical shape, a spray method, vertical ring method, or dip coating method can be used as the coating method. A film thickness of the charge generating layer 5 is, preferably, about from 0.05 to 5 μm and, more preferably, from about 0.1 to 1 μm.

In a case where the conductive substrate 3 formed with the undercoat layer 4 has a sheet-like shape, an applicator, bar coater, casting, or spin coating can be used for the coating method.

The charge transporting layer 6 can be constituted with incorporation of a known charge transporting substance and a binder resin. The transporting substance having an ability of accepting charges generated from the charge generating substance contained in the charge generating layer 5 and transporting the charges may suffice. The charge transporting substance includes electron donating substances, for example, the compound represented by the structural formula (1), a poly-N-vinylcarbazole and derivative thereof, poly-g-carbazolylethylglutamate and derivative thereof, polyvinyl pyrene, polyvinyl phenanthrene, oxazole derivative, an oxadiazole derivative, an imidazole derivative, 9-(p-diethylaminostyryl) anthracene, 1,1-bis(4-dibenzylaminophenyl)propane, styrylanthracene, styrylpyrazoline, pyrazoline derivative, phenylhydrazoneds, hydrazone derivatives, triphenylamine compounds, tetraphenyldiamine compounds, stylbene compounds, or azine compounds such as 3-methyl-2-benzothiazoline ring. Among them, the compound represented by the structural formula (1) is particularly preferred. The charge transporting substances can be used alone, or two or more of them may be used in combination.

(1)

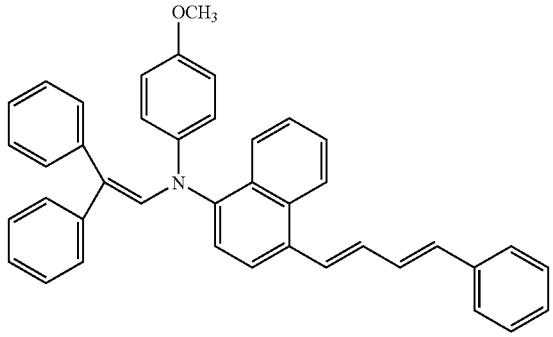

The binder resin which constitutes the charge transporting layer 6 may be those compatible with the charge transporting substance and includes, for example, polycarbonate, copolymerized polycarbonate, polyallylate, polyvinyl butyral, polyamide, polyester, epoxy resin, polyurethane, polyketone, polyvinyl ketone, polystyrene, polyacrylamide, phenol resin, phenoxy resin and polysulfone resin, and copolymer resins thereof. Those resins can be used alone or two or more of them may be used in admixture. Among the binder resins described above, resins such as polystyrene, polycarbonate and copolymerized polycarbonate, polyallylate and polyester have a volumic resistivity of $10^{13}$ Ω or more and have excellent film-forming property and potential characteristics.

As the solvent for dissolving the substances described above, alcohols such as methanol or ethanol, ketones such as acetone, methyl ethyl ketone or cyclohexanone, ethers such as ethyl ether, tetrahydrofuran, dioxane or dioxolane, halogenated aliphatic hydrocarbons such as chloroform, dichloromethane or dichloroethanes and aromatics such as benzene, chlorobenzene or toluene can be used. The solvent can be used alone or two or optionally more of them, can be used in combination.

A coating solution for charge transporting layer for forming the charge transporting layer 6 is prepared by dissolving the charge transporting substance in a binder resin solution. The ratio of the charge transporting substance based on the charge transporting layer 6 is preferably within a range from 30 to 80% by weight. The formation of the charge transporting layer 6 on the charge generating layer 5 is conducted in the same manner as the formation of the charge generating layer 5 on the undercoat layer 4. A thickness of the charge transporting layer 6 is preferably from 10 to 50 μm and, more preferably, from 15 to 40 μm.

The charge transporting layer 6 may be incorporated with one or more electron accepting substances or dyes, for improving the sensitivity and suppressing the increase of residual potential and fatigue by repetitive use. Examples of the electron accepting substance include acid anhydrides such as succinic acid anhydride, maleic acid anhydride, phthalic acid anhydride or 4-chlornaphthalic acid anhydride, cyano compounds such as tetracyanoethylene or terephthal malonedinitrile, aldehydes such as 4-nitrobenzaldehyde, anthraquinones such as anthraquinone or 1-nitroanthraquinone, polycyclic or heterocyclic nitro compounds such as 2,4,7-trinitrofluolenone or 2,4,5,7-tetranitrofluolenone, and they can be used as a chemical sensitizer. Examples of the dye include, for example, organic photoconductive compound such as xanthene dyes, thiadine dyes, triphenylmethane dyes, quinoline pigments or copper phthalocyanine.

They can be used as photosensitizers. The electron accepting substances can be used alone or two or more of them may be used in combination.

Further, the charge transporting layer 6 may be incorporated with a known plasticizer to improve the moldability, flexibility and mechanical strength. Examples of the plasticizer include dibasic acid ester, fatty acid ester, phosphate ester, phthalate ester, chlorinated paraffin and epoxy type plasticizer. In addition, the photosensitive layer 7 may be incorporated, for example, with a leveling agent for preventing orange-peel appearance, phenolic compounds for improving durability, an anti-oxidant such as hydroquinone compounds, tocopherol compounds and amine compounds, and UV ray absorbers.

The physical property of the surface film of the photoreceptor 1 constituted as described above, that is, the physical property of the surface film of the photosensitive layer 7 formed into a film shape is set a creep value $C_{Fr}$ is 2.70% or more, and, preferably, 3.00% or more and, further preferably, 3.00 to 5.00%, and an elastic work efficiency $\eta_{HU}$ is 47% or more, preferably, 47 to 60% in a case where an indentation maximum load of 5 mN is loaded on the surface under a circumstance at a temperature of 25° C. and at a relative humidity of 50%.

Figure 3:
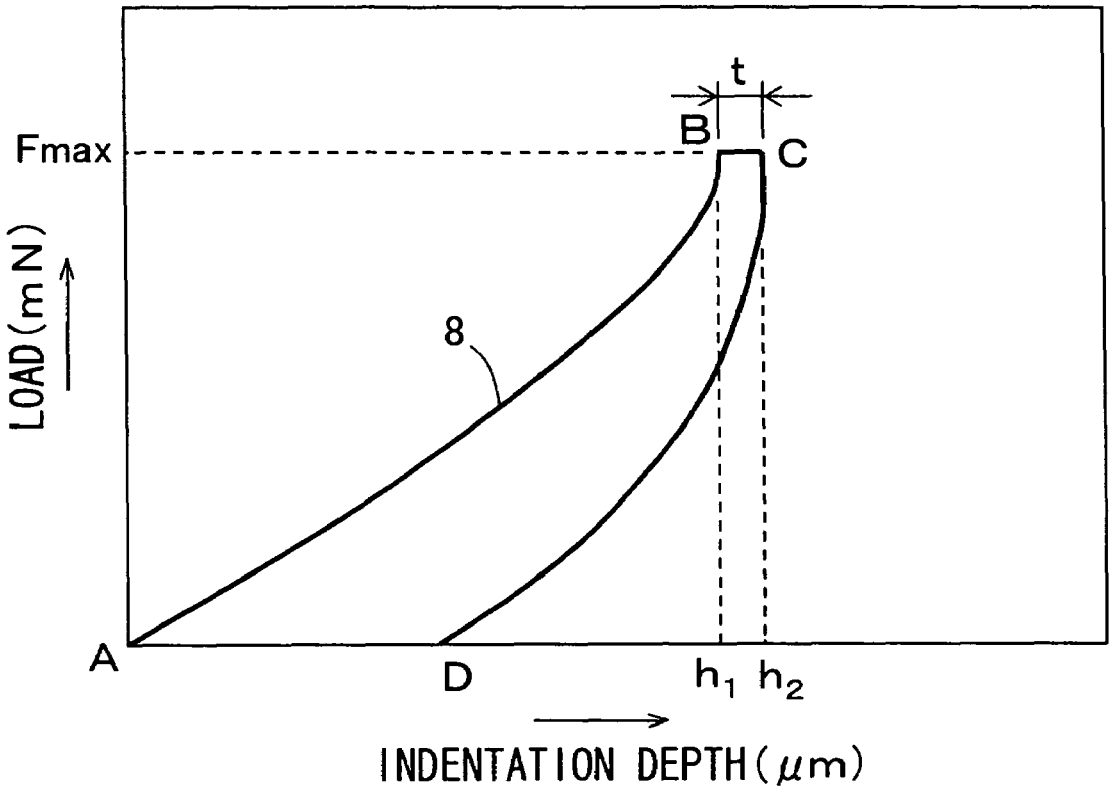
FIG. 3 is a chart explaining a method of determining a creep value $C_{IT}$ and elastic work efficiency $\eta_{HU}$.

Now the creep value $C_{Fr}$ is to be described. Generally, a solid material, even under a relatively low load, gradually develops a continuous deformation phenomenon, so-called creep, along with lapse of retention time of applied load and creep develops remarkably, particularly, in organic polymeric materials. The creep includes generally retarded elastic deformation component and plastic deformation component which is used as an index representing the soft and flexibility, that is, viscoelasticity of a material and it can be said to be particularly attributable to the viscosity. FIG. 3 is a chart for explaining a method of determining the creep value $C_{Fr}$ and the elastic work efficiency $\eta_{HU}$ of a photoreceptor. The creep value $C_{Fr}$ is a parameter for evaluating the amount of change of the indenting amount of an indenter under a state of applying a predetermined load for a predetermined time on the surface of a photoreceptor by way of the indenter, that is, the degree of relaxation of the surface film of the photoreceptor relative to the indentation load.

A hysteresis profile 8 shown in FIG. 3 shows a deformation (change of indented depth) hysteresis consisting of an indenting process from starting the application of pressing load to the surface of the photoreceptor 1 till reaching a predetermined maximum indentation load Fmax (A→B), a load retaining process for retaining the maximum indentation load Fmax for a predetermined time t (B→C), and a load removing process from starting the load removal till reaching 0 load (0) to complete load removal (C→D), and the creep value $C_{Fr}$ is given by the amount of change of the indenting amount in the load retaining process (B→C).

In this embodiment, the creep value $C_{Fr}$ was measured by using a diamond indenter (Vickers indenter) of a square pyramidal shape as an indenter under a circumstance at a temperature of 25° C. and at a humidity of 50% and under the condition of retaining the load for a predetermined period: t=5 sec at the maximum indentation load: Fmax=5 mN. The creep value $C_{Fr}$ is specifically given by the following equation (1):

$$C_{Fr}=100\times(h_2-h_1)/h_1 \quad (1)$$

in which $h_1$ represents an indented depth at the instance (B) reaching the maximum load 5 mN is reached; and $h_2$ represents an indented depth at the instance (C) after retained for a time t at the maximum load 5 mN.

Such creep value $C_{Fr}$ is determined, for example, by a Fisher Scope H100V (manufactured by Fisher Instrument Co.)

The reason for defining the creep value $C_{Fr}$ for the surface of the photoreceptor 1 will be described below. While the surface of the photoreceptor 1 is deformed by an energy given when a cleaning member or the like is indented, the internal energy caused by deformation is relaxed (dispersed) to suppress proceeding of wear by defining the creep value $C_{Fr}$ to 2.70% or more thereby providing soft and flexibility. That is, the wear resistance life of the photoreceptor is improved. In a case where the creep value $C_{Fr}$ is less than 2.70%, the soft and flexibility on the surface of the photoreceptor is poor and the wear resistance to the frictional rubbing with the cleaning member or the like is lowered to shorten the life.

While the upper limit for the creep value $C_{Fr}$ is not particularly limited, it is preferably set to 5.0% or less. In a case where the creep value $C_{Fr}$ exceeds 5.0%, the surface of the photoreceptor becomes excessively soft and flexible and, the deformation amount by indentation upon frictional rubbing, for example, with a cleaning member is large failing to sometimes obtain a sufficient cleaning effect.

Then, the elastic work efficiency $\eta_{HU}$ will be described below. In a case where a load is applied on a solid material, the mechanical work-energy $W_{total}$ consumed during indentation is used only partially as the plastic deformation energy $W_{plast}$ and the remaining portion thereof is released as the elastic recovery work energy (elastic deformation work energy) $W_{elast}$ during load removal. Further, the elastic recovery work energy (elastic deformation work energy) $W_{elast}$ includes an instantaneous elastic deformation component and a retarded elastic deformation component. The elastic work efficiency $\eta_{HU}$ represents the viscoelasticity of a material like in the case of the creep value $C_{Fr}$, this is a parameter particularly attributable to the elastic recovery. The elastic work efficiency $\eta_{HU}$ in this embodiment is determined as described below. At first, in the hysteresis profile 8 upon determining the creep value $C_{Fr}$, described above, since the mechanical work energy $W_{total}$ is: $W=\int F dh$, it is expressed by an area surrounded with an indented depth curve (A→B) during increase of load and the indented depth $h_1$, and the elastic recovery work energy $W_{elast}$ thereof is represented by an area surrounded with the indented depth curve (C→D) during load removal and an indented depth $h_2$. In this case, indentation in the load retaining process (B→C), that is, the creep is not included. The ratio of the work energy is the elastic work efficiency $\eta_{HU}$, which is represented by the formula (2):

$$\eta_{HU}=W_{elast}/W_{total}\times 100(\%) \quad (2)$$

in which $W_{total}=W_{elast}+W_{plast}$.

The elastic work efficiency $\eta_{HU}$ can be determined by a Fisher Scope H100V like the creep value described above.

The reason for defining the elastic work efficiency $\eta_{HU}$ of the surface of the photoreceptor 1 will be described below. Since the photoreceptor comprises a mixture of a resin and a low molecular weight material, the photoreceptor can not be a completely plastic body and inevitably contains an elastic component more or less. A direction where $\eta_{HU}$ decreases means that the elastic recovery is small upon application of external stress, that is, it approaches a plastic body. In a case where $\eta_{HU}$ is less than 47%, the elastic recovery is small relative to the external stress and the force applied leads as it is to the deformation of the surface and tends to cause wear or injury. Further, depending on the material of applying the load, although the deformation of the surface of the photoreceptor is small, reversion of the cleaning blade tends to occur for instance. Accordingly, the elastic work efficiency $\eta_{HU}$ is defined as 47% or more.

In the photoreceptor 1 in which the creep value $C_{\tau}$ and the elastic work efficiency $\eta_{HU}$ are set so as to be within a predetermined range, the viscoelasticity of the surface layer, that is, the film forming the photosensitive layer 7 is kept appropriately. That is, in a case where a load is applied on the surface of the photoreceptor, the energy is decreased by dispersion and repulsion such that the vertical force applied per unit area is decreased. Accordingly, since the amount of film reduction is decreased and occurrence of injury to the film is also mitigated to keep the smoothness on the surface of the photoreceptor even in long time use where image formation of charging, exposure, development, transfer, cleaning, and charge elimination is conducted repetitively, this can prevent occurrence of injury or unevenness of the density in the images to be formed. The control for the creep value $C_{\tau}$ and the elastic work efficiency $\eta_{HU}$ on the surface of the photoreceptor 1 is attained by controlling, for example, the kind and the blending ratio of the charge transporting substance and the binder resin constituting the photosensitive layer 7, stacked structure of the photosensitive layer 7, for example, combination of the thickness of the charge generating layer 5 and the thickness of the charge transporting layer 6, and the heat treatment condition after forming the charge generating layer 5 and the charge transporting layer 6.

Then, the operation of forming electrostatic latent images in the photoreceptor 1 will be described briefly. The photosensitive layer 7 formed to the photoreceptor 1 is uniformly charged, for example, negatively by a charger or the like and, when in the charged state the charge generating layer 5 is irradiated with a light having an absorption wavelength, charges of electrons and holes are generated in the charge generating layer 5. The holes are transported by the charge transporting substance contained in the charge transporting layer 6 to the surface of the photoreceptor 1 to neutralize negative charges on the surface, while electrons in the charge generating layer 5 move on a side of the conductive substrate 3 where positive charges are induced to neutralize the positive charges. As described above, difference is caused between the charged amount in the exposed portion and the charged amount in the not exposed portion to form an electrostatic latent image to the photosensitive layer 7.

Then, with reference to FIG. 2, the constitution and the image forming operation of the image forming apparatus having the photoreceptor 1 described above will be explained below. The image forming apparatus 2 exemplified in this embodiment is a digital copying machine 2.

The digital copying machine 2 has a constitution generally comprising a scanner station 11 and a laser recording section 12. The scanner station 11 includes a document platen 13 formed of transparent glass, a reversible automatic document feeder for both surfaces (RADF) 14 for supplying and feeding documents automatically onto the document platen 13 and a scanner unit 15 which is a document image reading unit for scanning images of an original document placed on the document platen 13 and the reading them. Document images read by the scanner station 11 are sent as image data to an image data input station to be described later, and predetermined image processing is applied to the image data. RADF 14 is a device for setting a plurality of documents at the same time on a document tray not illustrated provided to RADF 14, and feeding the set documents one by one automatically onto the document platen 13. Further, RADF 14 comprises a conveying path for document of a single surface, a conveying path for document of both surfaces, switching means for switching the conveying paths, a sensor group for recognizing and controlling the state of documents passing through each of the stations, a control station, etc.

The scanner unit 15 comprises a lamp reflector assembly 16 for exposing the surface of a document, a photoelectronic conversion device, for example a CCD image sensor 23, a first scanning unit 18 mounting a first reflection mirror 17 for reflecting the reflection light from the document for introducing the reflection light images from the document to the CCD image sensor 23, a second scanning unit 21 for mounting second and third reflection mirrors 19 and 20 for introducing the reflection light images from the first reflection mirror 17 to the CCD image sensor 23, an optical lens 22 for focusing reflection optical images from the document by way of each of the reflection mirrors 17, 19, and 20 to the CCD image sensor 23 that convert them into electrical image signals.

The scanner station 11 is constituted so as to successively feed and place the documents to be read on the document platen 13 by the interlocking operation of the RADF 14 and the scanner unit 15 and read the document images by moving the scanner unit 15 along the lower surface of the document platen 13. The first scanning unit 18 is moved at a constant velocity V in a direction of reading the document images along the document platen 13 (from left to right relative to the drawing in FIG. 2), and the second scanning unit 21 is moved in parallel at in the identical direction at a half speed relative to the speed V, i.e., V/2. By the operation of the first and the second scanning units 18 and 21, images of documents placed on the document platen 13 are focused on every line successively to the CCD image sensor 23 and images can be read.

The image data obtained by reading from the document images in the scanner unit 15 are sent to an image processing station to be described later and, after being applied with various kinds of image processing, are once stored in a memory of the image processing station, image data in the memory are read out in accordance with the output instruction, transferred to the laser recording section 13 and form images on the recording paper as the recording medium.

The laser recording section 12 comprises a recording paper conveying system 33, a laser writing unit 26 serving as exposure means, and an electrophotographic processing station 27 for forming images. The laser writing unit 26 comprises a semiconductor laser light source for emitting a laser light in accordance with image data read from the memory after being read by the scanner unit 15 and stored in the memory, or image data transferred from an external device, a polygonal mirror for deflecting the laser light at an equi-angular speed, and an f-θ lens for compensating the laser light deflected at an equi-angular speed so as to be deflected at the equi-angular speed on the photoreceptor 1 provided to the electrophotographic processing station 17.

In the electrophotographic processing station 27, a charger 28 serving as charging means, a developing device 29 serving as developing means, a transfer device 30 serving as transfer means, and a cleaning device 31 serving as cleaning means are arranged at the periphery of a photoreceptor 1 in this order from the upstream to the down stream in the rotational direction of the photoreceptor 1 shown by an arrow 32. As described above, the photoreceptor 1 is uniformly charged by the charger 28 and exposed in the charged state to laser light corresponding to the document image data emitted from the electrophotographic processing station 27. An electrostatic latent image formed on the surface of the photoreceptor 1 by exposure is developed by toner supplied from the developing device 29 into a toner image as a visible image. The toner image formed on the surface of the photoreceptor 1 is transferred by the transfer device 30 onto recording paper as a transfer material fed from a conveying system 33 to be described later. The cleaning means may be realized by a so-called development and cleaning system in which the residual toner is recovered by a cleaning function added to the developing means.

The photoreceptor 1 rotating further in the direction of the arrow 32 after transfer of toner images to the recording paper is frictionally rubbed at the surface thereof with a cleaning blade 31*a* provided to the cleaning device 31. Toner forming the toner images on the surface of the photoreceptor 1 is not entirely transferred onto the recording paper but sometimes remains slightly on the surface of the photoreceptor 1. The toner remaining on the surface of the photoreceptor is referred to as the residual toner and, since the presence of the residual toner causes degradation of the quality of the formed images, it is removed and cleaned from the surface of the photoreceptor together with other obstacles such as paper dusts by the cleaning blade 31*a* pressed to the surface of the photoreceptor.

The conveying system 33 for the recording paper comprises a conveying section 34 for conveying recording paper to the electrophotographic processing station 27, for conducting image formation, particularly, to a transfer position where the transfer device 31 is located, first to third cassette feeders 35, 36, and 37 for sending the recording paper into the conveying section 34, a manual feeder 38 for properly feeding recording paper of a desired size, a fixing device 39 for fixing an image, particularly, a toner image transferred from the photoreceptor 1 to the recording paper, and a re-feeding path 40 for re-feeding the recording paper for forming images further to the rear face of the recording paper after fixing of a toner image (surface on a side opposite to the surface formed with the toner image). A plurality of conveying rollers 41 are arranged along the conveying paths of the conveying system 33 and the recording paper is conveyed along the conveying rollers 41 to a predetermined position in the conveying system 33.

The recording paper applied with a fixing treatment for the toner image by the fixing device 39 is fed to the re-feeding path 40 for forming an image on the rear face, or fed to a post processing device 43 by a discharge roller 42. The recording paper fed to the re-feeding path 40 is applied with the foregoing operation repetitively and an image is formed at the rear face thereof. The recording paper fed to the post processing device 43 is applied with post processing and then discharged to any one of first or second discharge cassette 44 or 45 as a designation of discharge determined depending on the post processing step. Thus, a series of image forming operation in the digital copying machine 2 is completed. The photoreceptor 1 provided to the digital copying machine 2 is excellent in the soft and flexibility of the film that forms the photosensitive layer 7, and the plasticity of the film is not excessively soft or it is not fragile. Accordingly, since the amount of film reduction in the photoreceptor 1 is decreased and occurrence of injury to the film is also decreased to keep the smoothness on the surface of the photoreceptor 1, an image forming apparatus not suffering injury and unevenness in the density for images to be formed can be attained.

Figure 4:
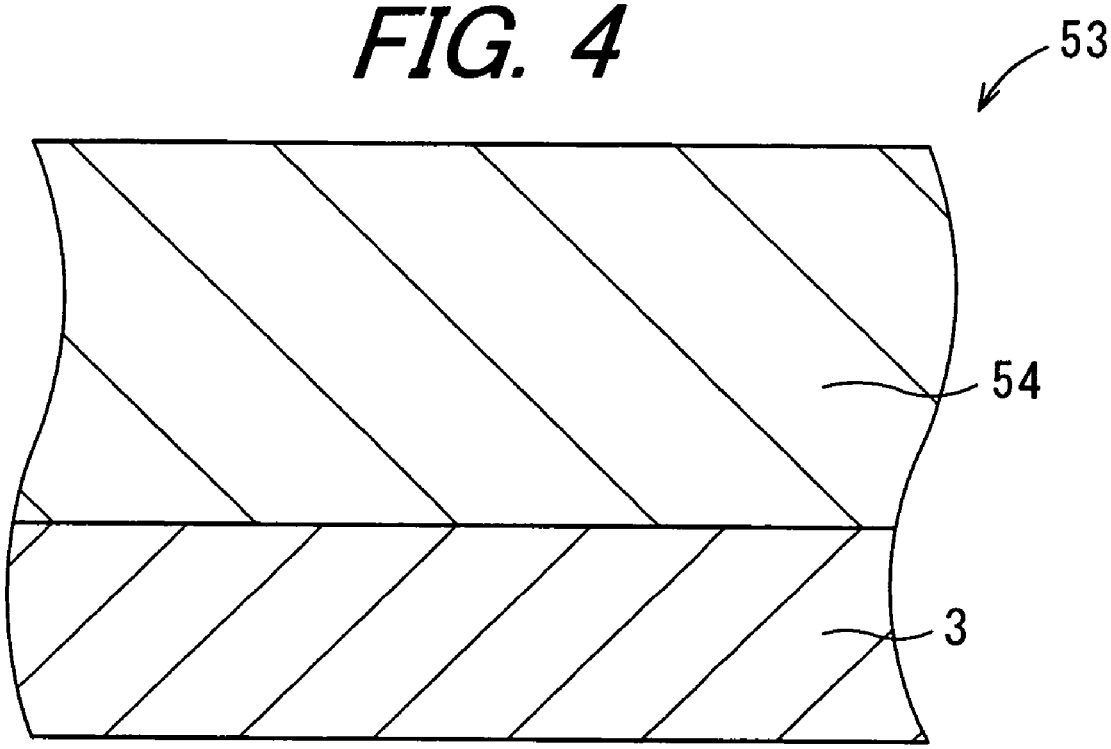
FIG. 4 is a fragmentary cross sectional view schematically showing the constitution of an electrophotographic photoreceptor according to still another embodiment of the invention.

FIG. 4 is a fragmentary cross sectional view schematically showing the constitution of a photoreceptor 53 according to still another embodiment of the invention. The photoreceptor 53 in this embodiment is similar with the photoreceptor 1 of the one embodiment of the invention shown in FIG. 1, corresponding portions will be denoted by the same reference numerals, and descriptions thereof will be omitted. What is to be noted in the photoreceptor 53 is that a photosensitive layer 54 comprising a single layer is formed on a conductive substrate 3.

The photosensitive layer 54 is formed by using the same charge generating substance, the charge transporting substance, the binder resin, etc. as those used for the photoreceptor 1 of the one embodiment. A single photosensitive layer is formed on the conductive substrate 3 by the same method as that for forming the charge generating layer 5 in the photoreceptor 1 of the one embodiment of the invention shown in FIG. 1, by using a coating solution for photoconductive layer prepared by dispersing the charge generating substance and the charge transporting substance in the binder resin or dispersing the charge generating substance in the form of pigment particles in the photosensitive layer containing the charge transporting substance. Since the photosensitive layer 54 to be formed consists of only one layer, the single layered type photoreceptor 53 of this embodiment is excellent compared with the stacked type constituted by laminating the charge generating layer and the charge transporting layer in view of the production cost and the yield.

EXAMPLE

The invention will be explained specifically with reference to examples and comparative examples. "part" means "part by weight" here and hereinafter.

Each component to be used in the examples is specifically as described below.

[Titanium Oxide]

Trade name: TTO-MI-1, dendritic rutile type titanium oxide treated at the surface with $Al_2O_3$ and $ZrO_2$, titanium component 85%, manufactured by Ishihara Sangyo Co. Ltd.

[Alcohol Soluble Nylon Resin]

Trade name: CM 8000, manufactured by Toray Industries, Inc.

[Butyral Resin]

Trade name: S-LECBL-2, manufactured by Sekisui Chemical Co. Ltd.

[Polycarbonate Resin]

Trade name: GH-503, manufactured by Idemitsu Kosan Co. Ltd.

Trade name: GK-400, manufactured by Idemitsu Kosan Co. Ltd.

Trade name: J-500, manufactured by Idemitsu Kosan Co. Ltd.

Trade name: TS 2040, manufactured by Teijin Chemicals Ltd.

[Polyester Resin]

Trade name: V 290, manufactured by TOYOBO Co. Ltd.

[Anti-oxidant]

Trade name: Irganox 1010, manufactured by Ciba Specialty Chemicals.

Trade name: Sumilizer BHT, manufactured by Sumitomo Chemical Co. Ltd.

The components are described each by the trade name here and hereinafter.

Example 1

3 parts of titanium oxide (TTO-MI-1) and 3 parts of an alcohol soluble nylon resin (CM 8000) were added to a mixed solvent of 60 parts of methyl alcohol and 40 parts of 1,3-dioxolane, the mixture was dispersed by a paint shaker for 10 hours to prepare a coating solution for undercoat layer. The coating solution was filled in a coating vessel, in which an aluminum cylindrical conducive support (diameter: 30 mm, length: 346 mm) was dipped and then taken up, spontaneously dried to form a undercoat layer having a layer thickness of 0.9 μm.

10 parts of a butyral resin (S-LEC BL-2), 15 parts of titanyl phthalocyanine represented by the following structural formula (2) and 1400 parts of 1,3-dioxolane were dispersed by a ball mill for 72 hours, to prepare a coating solution for charge generating layer. The coating solution was coated on the undercoat layer by the dip coating method in the same manner as in the case of the undercoat layer and spontaneously dried to form a charge generating layer having a layer thickness of 0.4 μm.

Then, as the charge transporting substance, 100 parts of the enamine compound represented by the structural formula (1), 99 parts of a polycarbonate resin (GH-503), 81 parts of a polycarbonate resin (TS2040) and 2.5 parts of an anti-oxidant (Irganox 1010) were mixed with 1140 parts of tetrahydrofuran and dissolved to prepare a coating solution for charge transporting layer. The coating solution was coated on the charge generating layer by a dip coating method, dried at 130° C. for 1 hour to form a charge transporting layer having a layer thickness of 28 μm. Thus, a photoreceptor of Example 1 was formed.

(2)

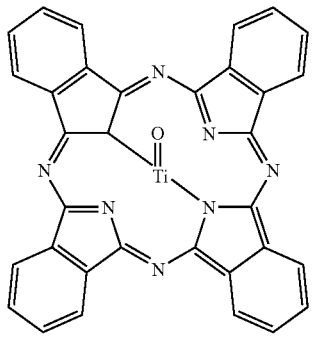

Example 2

A photoreceptor was formed in the same manner as in Example 1 except for using a bisbutadiene compound represented by the following structural formula (3) as the charge transporting substance.

Example 3

A photoreceptor was formed in the same manner as in Example 1 except for using 99 parts of a polycarbonate resin (GK-400) and 81 parts of a polycarbonate resin (GH503) as the binder resin for the charge transporting layer.

Comparative Example 1

A photoreceptor was formed in the same manner as in Example 1 except for using a coating solution for charge transporting layer prepared by dissolving 100 parts of a butadiene compound represented by the following structural formula (4) (charge transporting substance), 99 parts of a polycarbonate resin (GH-503), 81 parts of a polycarbonate resin (TS 2040), and 5 parts of an anti-oxidant (Sumilizer BHT) in 1140 parts of tetrahydrofuran.

(4)

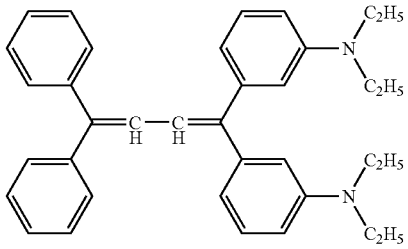

Comparative Example 2

A photoreceptor was formed in the same manner as in Example 1 except for using 99 parts of a polycarbonate resin (G-400) or 81 parts of a polycarbonate resin (GH503) as the binder resin for the charge transporting layer.

Comparative Example 3

A photoreceptor was formed in the same manner as in Example 1 except for using 54 parts of a polycarbonate resin (J-500), 36 parts of a polycarbonate resin (G-400), and 36 parts of a polycarbonate resin (GH503) or 54 parts of a polycarbonate resin (TS 2040) as a binder resin for the charge transporting layer.

(3)

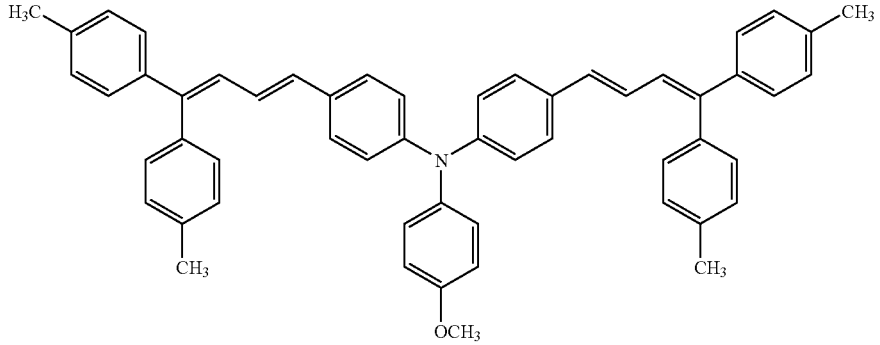

Comparative Example 4

A photoreceptor was formed in the same manner as in Example 1 except for using a coating solution for charge transporting layer prepared by dissolving 100 parts of a butadiene compound represented by the structural formula (4) (charge transporting substance), 180 parts of a polycarbonate resin (TS 2040) and 5 parts of an anti-oxidant (Sumilizer BHT) in 1140 parts of tetrahydrofuran.

Comparative Example 5

A photoreceptor was formed in the same manner as in Example 1 except for using a coating solution for charge transporting layer prepared by dissolving 100 parts of a styryl compound represented by the following structural formula (5) (charge transporting substance), 88 parts of a polycarbonate resin (G-400) and 72 parts of a polycarbonate resin (TS 2020) in 997 parts of tetrahydrofuran and setting the drying temperature for the charge transporting layer to 110° C.

(5)

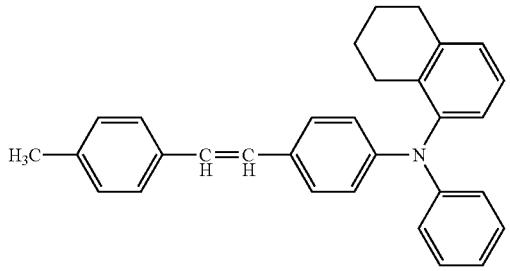

Comparative Example 6

A photoreceptor was formed in the same manner as in Example 1 except for using a coating solution for charge transporting layer prepared by dissolving 100 parts of a styryl compound represented by the following structural formula (6) (charge generating substance), 120 parts of a polycarbonate resin (G-400), 30 parts of a polyester resin (V290), and 1 part of an anti-oxidant (Sumilizer BHT) in 890 parts of tetrahydrofuran. The charge transporting layer was formed by coating the coating solution for charge transporting layer on the charge generating layer by the dip coating method and drying at 110° C. for 1 hour. The layer thickness of the layer was 28 μm.

(6)

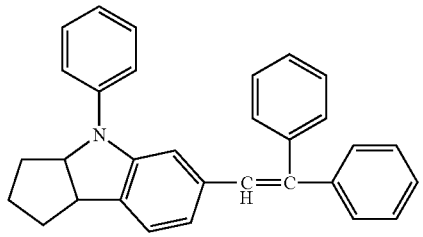

As described above, in the manufacture for each of photoreceptors of Examples 1 to 3 and Comparative 1 to 6, the creep value $C_{J\tau}$ and the elastic work efficiency $\eta_{HU}$ on the surface of the photoreceptor were controlled to desired values by changing the type and the content ratio of the charge transporting substance and the resin contained in the coating solution for charge transporting layer. The creep value $C_{J\tau}$ and elastic work efficiency $\eta_{HU}$ on the surface of the photoreceptors of Examples 1 to 3 and Comparative Examples 1 to 6 were measured by a Fisher Scope H100V (manufactured by Fisher Instruments Co.) under the circumstance at a temperature of 25° C. and at a relative humidity of 50%. The measuring conditions included maximum indentation load: W=5 mN, a necessary time of loading up to the maximum indentation load of 5 sec, the load retention time: t=5 sec and load removal time of 10 sec.

Each of the photoreceptors of Examples 1 to 3 and Comparative Examples 1 to 6 were attached to a modified AR-450 machine which was modified from a hybrid machine AR-450 (manufactured by Sharp Corp.) having a non-contact charging process for the testing, and an evaluation test for printing resistance and image quality stability was conducted by forming images. Then, the evaluation method for each performance is to be described.

[Printing Resistance]

The pressure of a cleaning blade of a cleaning device provided to the modified AR-450 machine abutting against the photoreceptor, a so-called, cleaning blade pressure was adjusted to 21 gf/cm ($2.06\times10^{-1}$ N/cm) as a initial linear pressure. A character test chart was formed to 100,000 sheets of recording paper on every photoreceptor and a printing resistant test was conducted under a normal temperature/normal humidity (N/N) circumstance at a temperature of 25° C. and at a relative humidity of 50%.

The film thickness upon starting the printing resistant test and after forming images to 100,000 sheets of recording paper, that is, the thickness of the photosensitive layer was measured by a using an instantaneous multi light measuring system by light interference method (MCPD-1100: trade name of products manufactured by Ohtsuka Electronic Co., Ltd.) and the film reduction amount of the photoreceptor drum was determined based on the difference between the film thickness upon starting the printing resistant test and after forming images for 100,000 sheets of recording paper. As the amount of film reduction was larger it was evaluated that the printing resistance was worse.

[Image Quality Failure by Injury]

After forming images for 100,000 sheets of recording paper in the modified machine attached with each of the photoreceptors, half-tone, white solid and black solid images were further formed. By visually observing the images, image failure due to injury was detected, and the level of lowering the image quality due to the injury of the photoreceptor, that is, the image quality stability was evaluated after the printing resistant test. The criterion for the evaluation of injuries was described below.

A: good, with no image failure due to injury to half-tone, white solid, and black solid images B: level with no practical problem. Image failure was present due to slight injury in the images C: level with practical problem. image failure was present due to injury to images.

The results of evaluation are collectively shown in Table 1.

TABLE 1

| | | Physical property value | | Injury (after printing resistant test for 100,000 sheets) | Film reduction amount (μm/100 k rotation) |
|---|---|---|---|---|---|
| | | $C_{I\tau}$ (%) | $\eta_{HU}$ (%) | | |
| Example | 1 | 3.15 | 48.6 | A | 0.68 |
| | 2 | 3.09 | 48.8 | A | 0.62 |
| | 3 | 2.97 | 47.8 | A | 0.73 |
| Comp. Example | 1 | 3.01 | 43.7 | A | 2.16 |
| | 2 | 3.43 | 45.8 | A | 0.86 |
| | 3 | 3.42 | 45.1 | A | 1.03 |
| | 4 | 3.36 | 44.3 | A | 1.57 |
| | 5 | 2.68 | 47.1 | B | 0.81 |
| | 6 | 2.00 | 39.9 | C | 2.58 |

In the photoreceptor of the invention, that is, the photoreceptor in which the creep value $C_{I\tau}$ was 2.70% or more and the elastic work efficiency $\eta_{HU}$ was within a range of 47% or more, the amount of film reduction was small and the printing resistance was excellent and no injuries were observed even in the image after printing test for 100,000 sheets. Particularly, in the photoreceptors of Examples 1 and 2 with $C_{I\tau}$ of 3.00% or more, the amount of film reduction was somewhat smaller. This is considered that in the photosensitive layer constituting the surface of the photoreceptor the soft and flexibility, particularly, the viscosity of the film represented by the creep value and the elasticity of the film represented by the elastic work efficiency $\eta_{HU}$ is appropriately balanced.

On the other hand, in the photoreceptors of Examples 1 to 4, while $C_{I\tau}$ was 3.00% or more, $\eta_{HU}$ was small and although satisfactory result were shown for injury, the amount of film reduction was large to provide a result of poor printing resistance. This is considered that the elasticity of the film reflected to the elastic work efficiency $\eta_{HU}$ was somewhat smaller and the film was scraped before forming injury by frictional rubbing.

Further, while only the charge transporting substance and the additives are different between the photoreceptors of Example 1 and Comparative Example 1, it can be said that Example 1 using the enamine compound represented by the structural formula (1) had large elastic work efficiency $\eta_{HU}$ and the amount of film reduction was small to provide excellent result and the charge transporting substance of the structural formula (1) was excellent even when an identical resin was used.

In the photoreceptor of Comparative Example 5, $C_{I\tau}$ was small to provide a result somewhat sensitive to the injury. This considered that since the soft and flexibility of the film represented by the creep value, particularly, the viscosity was smaller than the elasticity of the film reflected to the elastic work efficiency $\eta_{HU}$, this formed not recoverable injury by frictional rubbing as the external stress.

In the photoreceptor of Comparative Example 6, both $C_{I\tau}$ and $\eta_{HU}$ were small to provide results that both the film reduction and injury were poor. This is considered that since the viscoelasticity of the film was entirely small and a film lacking in soft and flexibility was formed.

As has been described above, in this embodiment, the surface of the photoreceptor is constituted with the photosensitive layer and it is not applicable to a case where a surface protective layer is provided further to the outer layer of the photosensitive layer.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An electrophotographic photoreceptor comprising:

a conductive substrate;

an undercoat layer; and an organic photosensitive layer, wherein the organic photosensitive layer has a creep value $C_{I\tau}$ of 2.70% or more and an elastic work efficiency $\eta_{HU}$ of 47% or more when an indentation maximum load of 5 mN is loaded on its surface under a circumstance at a temperature of 25° C. and at a relative humidity of 50%, wherein the organic photosensitive layer comprises a charge generating layer laminated on the conductive substrate, and a charge transporting layer is stacked further on the charge generating layer, said charge transporting layer containing a charge transporting substance and at least one binder resin comprising two separate polycarbonates, and wherein the charge transporting substance is a compound represented by the following structural formula (1)

(1)

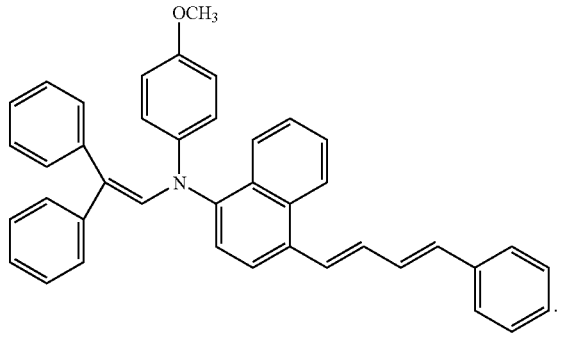

2. An electrophotographic photoreceptor comprising:

a conductive substrate; and an organic photosensitive layer, wherein the organic photosensitive layer has a creep value $C_{I\tau}$ of 2.70% or more and an elastic work efficiency $\eta_{HU}$ of 47% or more when an indentation maximum load of 5 mN is loaded on its surface under a circumstance at a temperature of 25° C. and at a relative humidity of 50%, wherein the organic photosensitive layer comprises a charge generating layer laminated on the conductive substrate, and a charge transporting layer is stacked further on the charge generating layer, said charge transporting layer containing a charge transporting substance and binder resins comprising two polycarbonates, and wherein the charge transporting substance is a compound represented by the following structural formula (3).

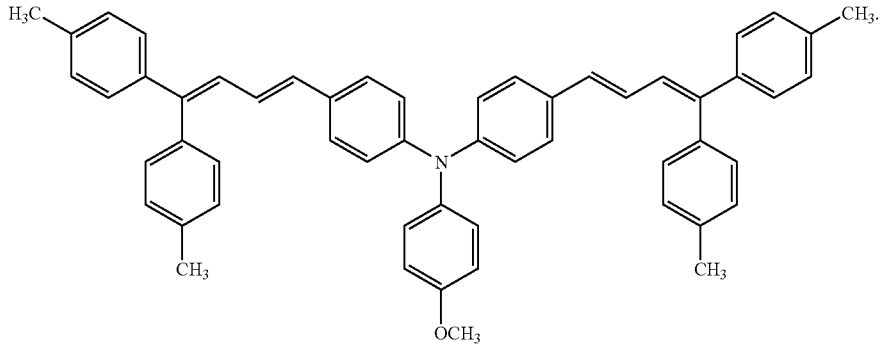

(3)

3. The electrophotographic photoreceptor of claim 1 or 2, wherein the creep value $C_{Fr}$ is 3.00% or more.

4. An image forming apparatus comprising:

the electrophotographic photoreceptor of claim 1 or 2; and cleaning means for cleaning a surface of the electrophotographic photoreceptor after transfer of a toner image formed thereon.

5. The image forming apparatus of claim 4, further comprising:

charging means for uniformly charging the surface of the electrophotographic photoreceptor;

exposure means for exposing the charged electrophotographic photoreceptor to light to form an electrostatic latent image;

developing means of developing the electrostatic latent image to form a visible image; and transfer means for transferring the visible image to a transfer material.

* * * * *